US006745400B1

(12) United States Patent
Paciorkowski

(10) Patent No.: US 6,745,400 B1
(45) Date of Patent: Jun. 8, 2004

(54) PROTECTIVE GARMENT FOR GAME OF PAINTBALL

(76) Inventor: Tracy James Paciorkowski, 25 Humphrey Ave., Bayonne, NJ (US) 07002

( * ) Notice: Subject to any disclaimer, the term of this patent is extended or adjusted under 35 U.S.C. 154(b) by 0 days.

(21) Appl. No.: 10/419,344

(22) Filed: Apr. 21, 2003

(51) Int. Cl.[7] ..... A41D 13/00
(52) U.S. Cl. ..... 2/69; 2/23; 2/456
(58) Field of Search ..... 2/455, 456, 459, 2/461, 463, 464, 465, 466, 467, 468, 16, 22, 23, 24, 267, 268, 900, 69, 311, 227, 231, 244, 247, 250, DIG. 1

(56) References Cited

U.S. PATENT DOCUMENTS 759,833 A * 5/1904 Stall ..... 2/23
1,489,784 A * 4/1924 O'Shea ..... 2/113
1,654,452 A * 12/1927 Bradley ..... 2/227
4,507,801 A * 4/1985 Kavanagh et al. ..... 2/462
4,513,451 A * 4/1985 Brown ..... 2/69
4,608,716 A * 9/1986 Brumfield ..... 2/2.5
4,637,075 A * 1/1987 Ingrisano et al. ..... 2/94
4,669,125 A * 6/1987 Allen ..... 2/459
4,722,099 A * 2/1988 Kratz ..... 2/79
5,052,052 A * 10/1991 Gilford et al. ..... 2/467
5,105,478 A * 4/1992 Pyc ..... 2/115
5,159,718 A * 11/1992 Moyer ..... 2/69
5,337,418 A * 8/1994 Kato et al. ..... 2/456
5,673,836 A 10/1997 Bush
5,675,838 A * 10/1997 Hollinger ..... 2/69
5,742,939 A * 4/1998 Williams ..... 2/69
5,966,739 A 10/1999 Wagner
6,038,701 A * 3/2000 Regan ..... 2/125
6,041,436 A * 3/2000 Keen ..... 2/69
6,243,883 B1 6/2001 Boggs
6,260,196 B1 * 7/2001 van der Sleesen ..... 2/2.5
6,332,221 B1 * 12/2001 Gracey ..... 2/69
6,353,932 B2 * 3/2002 Stembridge ..... 2/69
6,357,054 B1 * 3/2002 Bainbridge et al. ..... 2/455
6,445,273 B1 9/2002 Yu

FOREIGN PATENT DOCUMENTS

CH 638665 A5 * 10/1983 ..... A41D/13/00

* cited by examiner

*Primary Examiner*—John J. Calvert
*Assistant Examiner*—Alissa L Hoey

(57) ABSTRACT

A one piece protective garment to be worn by children or adults while playing paintball has padding sewn into it at spots where injury is anticipated due to collision with other players and obstacles. There are also a belted waist, a collar, central zipper, and adjustable safety closures on the sleeves, pant legs, and ankles for adjusting the garment's fit. A removable padded bib covers the chest for extra protection. Mesh-like material on the armpits and chest ventilates the player to avoid overheating. Accessible compartments store accessories specific to the game of paintball. The garment's material is a camouflage design, or dark color, in order for the user to blend into the landscape and effectively hide from other players. The material is also water resistant and strong enough to resist normal wear and tear. A quilted pattern is aesthetically pleasing and increases the material's strength.

12 Claims, 3 Drawing Sheets

PROTECTIVE GARMENT FOR GAME OF PAINTBALL

Background

1. Field of Invention

The present invention relates to a protective garment for use in the game of paintball offering protection for the wearer as well as camouflage, to be used by both children and adults.

Paintball was invented and first played in the early 1980's. It is a game of tag where a player shot or "tagged" with a paintball marker is eliminated. It can be played between two players or up to a team of numerous players. It has grown as a sport and now enjoys international appeal for millions of children and adults.

It is characterized as an extreme sport, since it includes expulsion of a paintball marker (which is a thin skinned capsule filled with colored liquid) from a special airgun. The speed of a paintball marker shot at a player can reach speeds of up to 300 feet per second. Therefore, a protective garment with different shaped and sized padding sewn into the garment to protect the player from the high speed impact of the paintball marker is needed to ensure the safety of the player. A protective helmet and goggle system to protect the head and eyes are also worn by the players.

2. Description of the Prior Art

Prior art devices disclose various garments for use in hunting, and high impact sports. None of the prior art devices are designed specifically for the game of paintball and none have unique features adapted for use in the game of paintball. Also, the garments or uniforms that are presently marketed for paintball play do not have the specific safety features, such as different shaped and sized padding sewn into the garment and accessory holders, that are features of the present invention.

There are several patents which disclose various garments for use during physical activities, such as hunting, baseball, and soccer, among others.

| Inventor | Patent Number | Date |
|---|---|---|
| Gillen et. al | U.S. Pat. No. 6,446,273 B1 | Sep. 10, 2002 |
| Boggs | U.S. Pat. No. 6,243,883 | Jun. 12, 2001 |
| Wagner | U.S. Pat. No. 5,966,739 | Oct. 19, 1999 |
| Bush | U.S. Pat. No. 5,673,836 | Oct. 7, 1997 |

Gillen et. al., U.S. Pat. No.: 6,446,273 B1, dated Sep. 10, 2002, is a protective body vest for protecting against impact upon the torso of an athlete during sporting activities. The protective padding of Gillen, et. al, also provides for removal and insertion of the protective padding based on the user's needs.

The present invention differs from Gillen, et. al., since it protects the user's entire body (except head), and the padding is sewn into the device, in order to be sturdily constructed and not to tear away easily when the user is playing the game of paintball.

Boggs, U.S. Pat. No.: 6,243,883, dated Jun. 12, 2001, is a protective device adapted particularly for use by a soccer player that includes a front and rear panel connected to each other by elastic straps.

The instant invention differs from Boggs, since the instant invention's straps adjust the fit of protective padding sewn into the device. The protective padding is not held onto the device by the straps. Boggs would not be suitable for use in playing the game of paintball, since the physical activity of paintball is much more strenuous that that of soccer and its panels would be ripped away from the elastic straps during paintball play.

Wagner, U.S. Pat. No.: 5,966,739 dated Oct. 19, 1999, is for pants used in the game of hockey, specifically for the goalie player. The specific structure of the pants of Wagner's invention are geared to allow for use when the goalie's knees are on the ice, such as retractable pads.

The present invention differs from Wagner, in that it is a garment that has protective padding sewn into it that protects the user's entire body (except head) during the game of paintball. None of the padding of the instant device retracts like Wagner's garment, since that would not be safe for use in paintball.

Bush, U.S. Pat. No. 5,673,836 dated Oct. 7, 1997, is a modular compartmentalized vest for outdoor apparel to be used for hunting, which allows for easy access to storage on panels of the vest, with elastic straps sewn into panels which act as holders of ammunition and hunting calls, among other devices used in hunting.

The present invention differs from Bush, in that Bush does not function as a protective device. The present invention has different sized and shaped padding sewn into it to protect the user from impact of the paintball markers and collision with other players and obstacles during play.

Additionally, the accessory holders of the present invention are specifically shaped and placed on the garment to accommodate the unique accessories used in playing paintball, such as squeegee and paintball marker canisters. None of the prior art inventions have these specific accessory holders.

In view of the above, there is a need for a protective garment, consisting of one piece that protects the entire body with padding (except for the head which is protected by a helmet and goggles system) and which has built in accessory holders specifically adapted for the accessories used in paintball.

OBJECTS AND ADVANTAGES

Accordingly, besides the distinctions from the prior art stated above, several objects and advantages of the present invention are:

- To provide for a device wherein the player is protected by different sized and shaped padding sewn into the garment at locations where the probability of impact during the game of paintball is likely;
- To provide for a device wherein a mesh material covers the underarm and chest areas for ventilation during play so as to avoid overheating of the player;
- To provide for a device wherein accessories are sewn into the garment to safely hold the paintball marker canisters and squeegee game accessories to facilitate play and minimize accidental injuries during play;
- To provide for a device wherein the player can wear one integral suit for easy suiting up and removal of the garment;
- To provide for a device wherein a safe and comfortable collar fit can be easily adjusted by tabs made out of velcro, wherein if the collar is caught on branches or other objects, the tabs release so as not to catch the player and cause injury.
- To provide for a device wherein a safe and comfortable fit on the sleeves and pant legs can be easily adjusted by straps with safety closures made out of plastic and/or velcro to ensure that there is no slack in the upper and lower torso of the garment that may catch onto branches or other obstacles and cause injury;

To provide for a device wherein the garment is made of material that is water resistant and easily cleaned;

To provide for a device wherein the garment is made of material with a camouflage pattern or dark color in order for the player to blend into the background to hide from other players; and To provide for a device preferably made of durable cloth, so as not to be easily torn.

REFERENCE NUMBERS IN THE DRAWINGS

Figure 1:
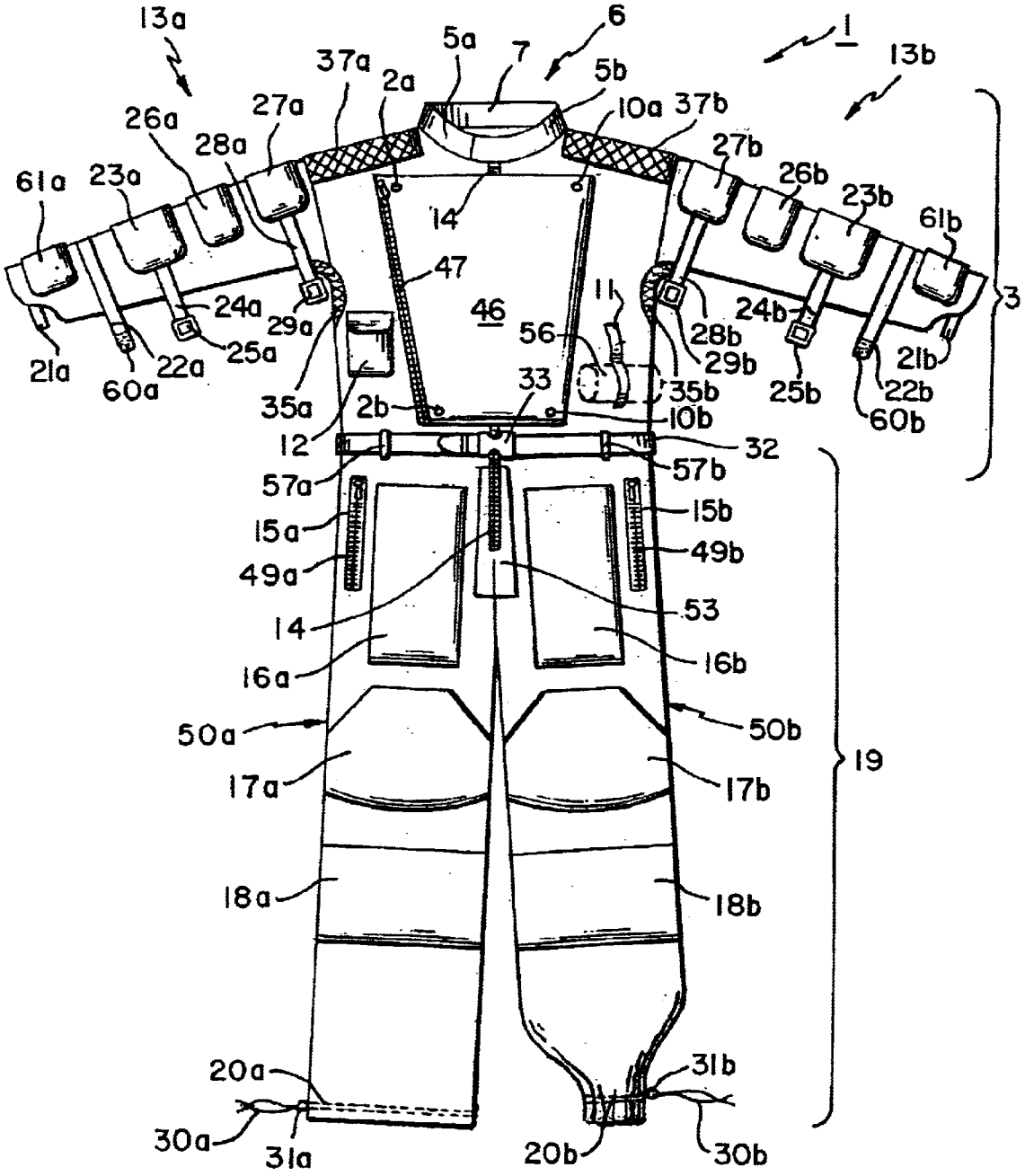
FIG. 1. Is a perspective frontal view of the present invention with its central body zipper, chest bib zipper, pair of hip side pocket zippers, collar and waist belt closed, paintball marker canister (shown in phantom) placed into its holder, one leg's ankle drawstring adjusted tight, one leg's ankle drawstring loose, and one arm with safety closures adjusted tight and other arm with safety closures open and loose.

1. garment
2*a* and 2*b*. pair of female snaps of chest bib
3. upper torso portion
4. female waist belt buckle portion
5*a* and 5*b*. pair of front collar tabs
6. collar
7. padded collar back
8*a* and 8*b*. pair of velcro closures for front collar tabs
9.
10*a* and 10*b* pair of male snaps of chest bib
11. front holder for paintball marker canister
12. front side rib pocket with flap closure
13*a* and 13*b*. pair of sleeves
14. central body zipper
15*a* and 15*b*. pair of side hip pockets
16*a* and 16*b*. pair of thigh padding
17*a* and 17*b*. pair of knee padding
18*a* and 18*b*. pair of shin padding
19. lower torso portion
20*a* and 20*b*. pair of ankle tunnel stitching
21*a* and 21*b*. pair of cuff straps
22*a* and 22*b*. pair of wrist straps
23*a* and 23*b*. pair of elbow padding
24*a* and 24*b*. pair of elbow straps
25*a* and 25*b*. pair of elbow strap safety closures
26*a* and 26*b*. pair of biceps padding
27*a* and 27*b*. pair of forearm padding
28*a* and 28*b*. pair of forearm straps
29*a* and 29*b*. pair of forearm strap safety closures
30*a* and 30*b*. pair of ankle drawstring stopper closings
31*a* and 31*b*. pair of ankle drawstring
32. waist belt
33. waist belt buckle
34. male waist belt buckle portion
35*a* and 35*b*. pair of mesh underarm panels
36.
37*a* and 37*b*. pair of shoulder padding
38*a* and 38*b*. pair of seat padding
39*a* and 39*b*. pair of back thigh padding
40*a* and 40*b*. pair of knee straps
41*a* and 41. pair of knee strap safety closures
42*a* and 42*b*. pair of shin straps
43*a* and 43*b*. pair of shin strap safety closures
44*a* and 44*b*. pair of kidney padding
45*a* and 445*b*. pair of chest side panels
46. chest bib
47. chest bib zipper
48.
49*a* and 49*b*. pair of zipper closures on pair of hip pockets
50*a* and 50*b*. pair of pant legs
51.
52. back padding
53. crotch padding
54. squeegee pocket
55. squeegee
56. paintball marker canister
57*a* and 57*b*. pair of front belt loops
58. back waist band cover
59. loop squeegee holder
60*a* and 60*b*. pair of wrist strap velcro closures
61*a* and 61*b*. pair of wrist padding
62. rear paintball marker canister holder

SUMMARY OF THE INVENTION

This invention relates generally to a protective garment to be worn by both children and adult players of the game of paintball. For safety, all players are required to wear a protective helmet and goggle system, to protect the eyes and face. Protective garments are recommended for safety. The instant invention has different sized and shaped padding sewn into it at locations where the possibility of injuries due to impact with paintball markers or collision with other players or obstacles is anticipated.

There are also straps with safety closures made of plastic or velcro sewn onto the sleeves and pant legs, and collar for adjusting the garment to fit tightly, not loosely. These safety closures ensure that the player's garment won't catch onto branches and cause accidents. There are also specially shaped compartments for safely holding accessories used in playing the game of paintball, such as the paintball marker canisters, and a squeegee. Mesh panels on the chest side panels and armpits allow for air circulation and ensure that the player won't become overheated.

The garment is made from a dark colored material or a camouflage design, in order for the user to blend into the landscape to hide effectively from other players. The material is also water resistant and can be easily cleaned off and stored after play. The material must also be strong enough to resist normal wear and tear and be long wearing.

DESCRIPTION OF THE PREFERRED EMBODIMENT OF THE INVENTION

Referring to the drawings by numerals of reference, this invention relates generally to a protective garment for use in the game of paintball comprising different shaped and sized padding sewn into the garment for protecting the player from impact of high speed paintball markers and collision with other players or obstacles during play.

FIG. 1. illustrates the front view of the one-piece garment 1, showing closed central body zipper 14 laterally connecting the upper and lower torso portions, 3 and 19, respectively. Waist belt 32 is shown with buckle 33 closed, with female buckle portion 4 and male waist buckle portion 34 (shown in FIG. 2), attached to create a snug fit for the player. This snug fit safely prevents the garment from accidentally catching onto obstacles during game play. A pair of front belt loops 57*a* and 57*b* (shown in FIG. 1) and back belt cover 58 (shown in FIG. 2) also assist in snugly affixing the belt 32 to the garment 1.

Figure 2:
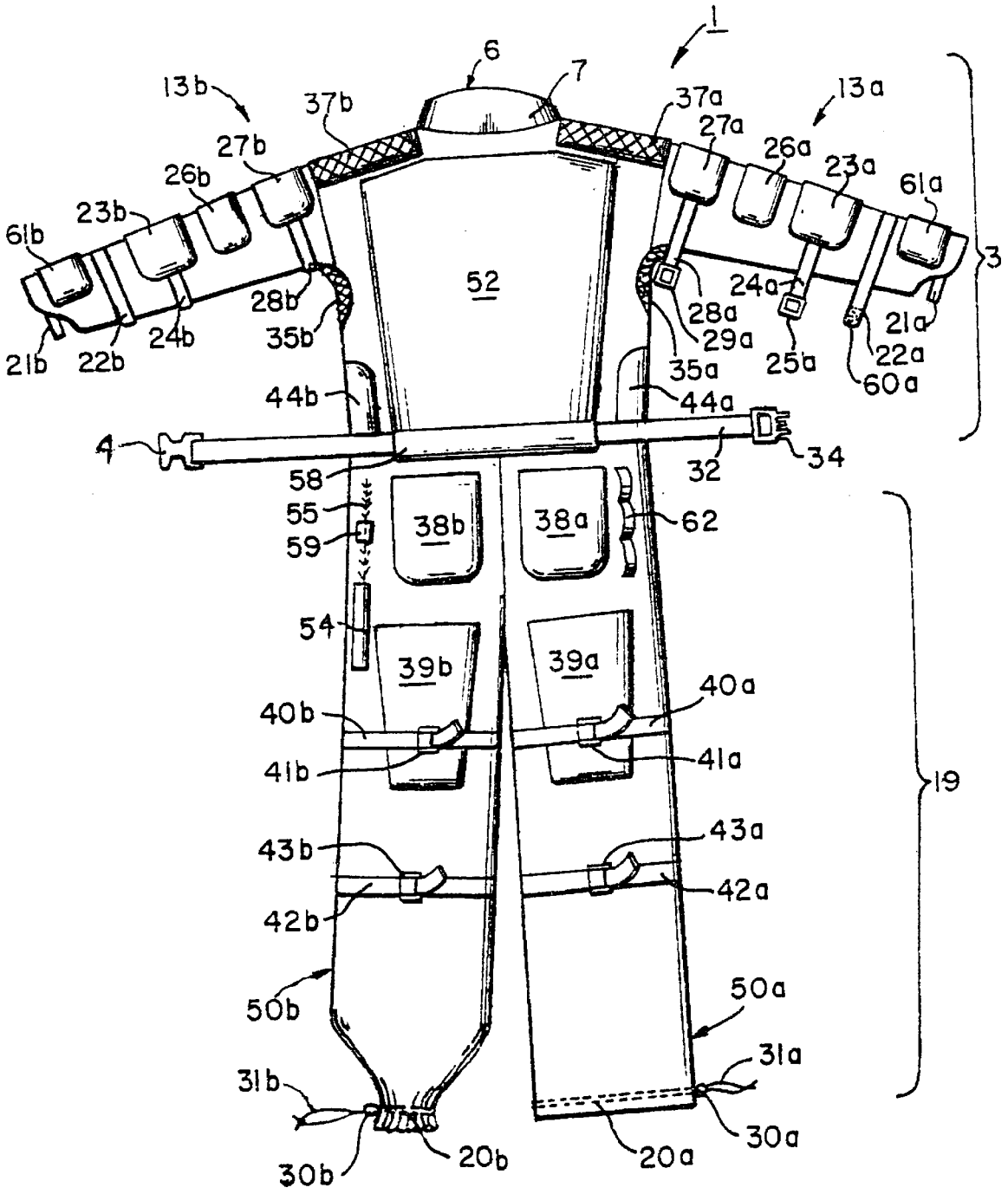
FIG. 2. Is a perspective back view of the present invention with its waist belt open, showing back belt cover, squeegee (shown in phantom) placed into its holder, paintball marker canister holder empty, both leg's safety closures adjusted tight, and both sleeves safety closures, ankle drawstrings and collar adjusted the same as in FIG. 1.

As shown in FIGS. 1 and 2, protective safety padding of varying sizes and shapes give extra protection to vulnerable areas of the player's body. This padding is preferably made of neosprene (or similar) material and is one quarter (¼) of an inch in thickness. From the upper torso 3 through the lower torso 19, this padding includes: padded collar back 7, chest bib 46, back padding 52, pair of shoulder padding 37*a* and 37*b*, pair of biceps padding 26*a* and 26*b*, pair of forearm padding 27*a* and 27*b*, pair of elbow padding 23*a* and 23*b*, pair of wrist padding 61*a* and 61*b*, pair of kidney padding 44*a* and 44*b*, crotch padding 53, pair of seat padding 38*a* and 38*b*, pair of thigh padding 16*a* and 16*b*, pair of back thigh padding 39*a* and 39*b*, pair of knee padding 17*a* and 17*b*, and pair of shin padding 18*a* and 18*b*. This protective safety padding can also be quilted in an aesthetic design for decoration which also helps strengthen the material. As shown in FIGS. 1 and 2, the pair of shoulder padding 37*a* and 37*b* have a quilted design feature.

As shown in FIGS. 1 and 2, a snug fit of sleeves 13*a* and 13*b* is created by adjusting a pair of cuff straps 21*a* and 21*b*, (preferably elastic), a pair of wrist straps 22*a* and 22*b* with pair of closures 60*a* and 60*b* (preferably velcro or like material), pair of elbow straps 24*a* and 24*b* with pair of closures 25*a* and 25*b* (preferably safety closures), and pair of forearm straps 28*a* and 28*b* with pair of closures 29*a* and 29*b*, (preferably safety closures). For pant legs 50*a* and 50*b*, these include: a pair of knee straps 40*a* and 40*b* with pair of closures 41*a* and 41*b*, (preferably safety closures), and pair of shin straps 42*a* and 42*b* with pair of closures 43*a* and 43*b* (preferably safety closures).

Figure 3:
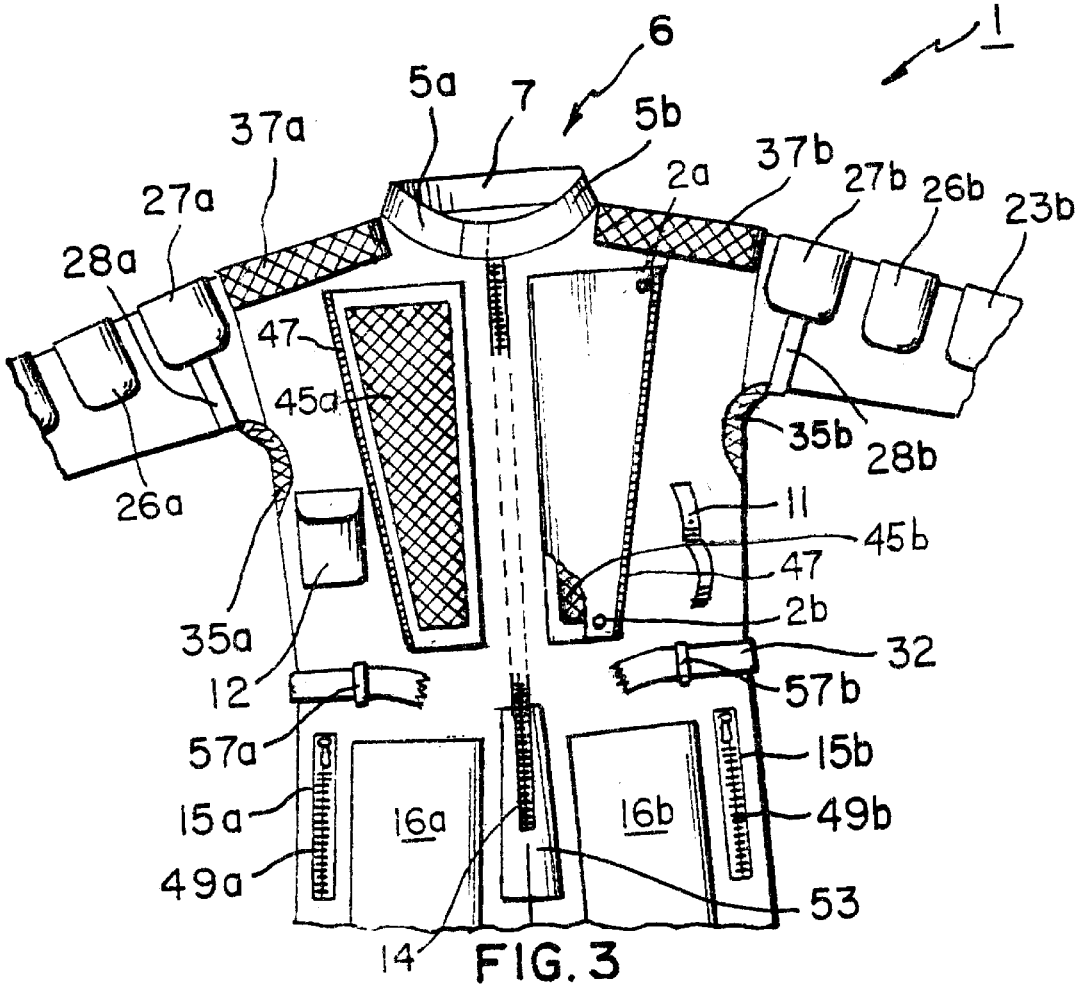
FIG. 3. Is a perspective frontal view of the present invention's chest bib in the folded open position, with its zipper open, with the folded chest bib in breakaway showing a mesh side panel under the folded chest bid, while the other mesh side panel is exposed, as well as is the mesh under the armpits.

As shown in FIG. 1 and in detail in FIG. 3, another safety feature of the device is that padded chest bib zipper 47 can be unzipped and open chest bib 46 can be folded over and attached to its opposite side with females snaps 2*a* and 2*b* snapping into males snaps 10*a* and 10*b*, exposing a pair of mesh chest side panels 45*a* and 45*b* which ventilate the player to ensure that the player does not become overheated.

As shown in FIGS. 1, 2, and 3, a pair of mesh underarm panels 35*a* and 35*b* also ventilate the player to ensure the player will not become overheated.

Figure 4:
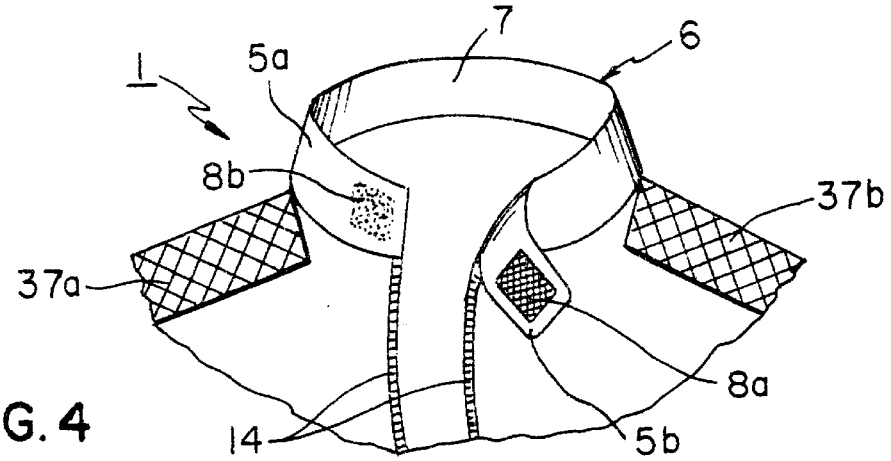
FIG. 4. Is a perspective frontal view of the present invention's open padded collar with velcro tab closures as well as open central body zipper.

As shown in FIG. 1 and 2, and in detail in FIG. 4, collar 6 is shown in the open position, with pair of front collar tabs 5*a* and 5*b* attached by pair of velcro closures 8*a* and 8*b* to ensure a snug fit so as not to allow any loose debris to hit the player's neck. The velcro closures 8*a* and 8*b* also allow for the collar to open if caught on any branches or other obstacles in order not to choke the player.

As shown in FIGS. 1 and 2, another safety feature includes a pair of ankle drawstrings 31*a* and 31*b* pulled closed at pair of stopper closures 30*a* and 30*b* through pair of tunnel stitching 20*a* and 20*b*, in order to adjust the length of the pair of pant legs 50*a* and 50*b* to the player's height, in order for the player avoid tripping during play.

As also shown in FIGS. 1 and 2, accessory holders are also built into the device to safely store the accessories to avoid accidental dropping or explosion during play which would cause the player to trip up or be injured. These include: front holder 11 (preferably elastic), for paintball marker canister 56 (shown in phantom), with a plurality of compartments (preferably holding two canisters), and rear paintball marker canister holder 62 (preferably elastic),with a plurality of compartments (preferably holding three canisters), and squeegee pocket 54 and loop 59 for holding a squeegee 55. A pair of side hip pockets 15*a* and 15*b* (with pair of zipper closures 49*a* and 49*b* shown in the closed position), and front side rib flap pocket 12 hold small objects.

I claim:

1. A one piece garment, to be used by both children and adult players of the game of paintball, comprising an upper and lower torso portion, said upper torso portion further comprising:

(a) a chest portion, consisting of a pair of side panel portions, (b) a pair of shoulder portions, (c) a back portion, consisting of a center panel portion, and a pair of side panel portions, (d) a pair of sleeve portions, consisting of a pair of cuff portions, a pair of wrist portions, a pair of elbow portions, a pair of biceps portions, a pair of forearm portions, and a pair of armpit portions, and (e) a collar portion, consisting of a pair of front tabs, and a back portion, and said lower torso portion further comprising:

(a) a waist portion, (b) a pair of hip portions, (c) a frontal crotch portion, (d) a pair of seat portions, and (e) pair of pant leg portions, consisting of a pair of front thigh portions and a pair of back thigh portions, a pair of knee portions, a pair of shin portions and a pair of ankle portions, whereby a plurality of protective padding is fixably attached by conventional stitch means to said pair of shoulder portions, said back portion's center panel portion, said back portion's pair of side panel portions covering said player's kidneys, and said pair of sleeve portion's said pair of wrist portions, said pair of elbow portions, said pair of biceps portions and said pair of forearm portions, said collar portion's back portion, said crotch portion, said pair of seat portions, and said pair of pant leg portion's said pair of front thigh portions and said pair of back thigh portions, said pair of knee portions, and said pair of shin portions of said garment, in order to protect said player from impact with objects during play, and wherein said pair of sleeve portions and said pair of pant leg portions further comprise a plurality of strap means which are fixably attached by conventional stitch means at said pair of sleeve portion's said pair of cuff portions, said pair of wrist portions, said pair of elbow portions, and said pair of forearm portions, said pair of pant leg portion's said pair of knee portions and said pair of shin portions, whereby said plurality of strap means are adjusted by conventional safety closures in order to fit said garment tightly onto said player to avoid catching said garment onto objects during play in order to minimize accidents.

2. A device as claimed in claim 1, wherein said chest portion is covered with a protective padded chest bib portion, which is fixably attached by said conventional stitch means to said chest portion on one side, and detachably attached by conventional zipper means to said chest portion on its other side, wherein when said zippered side of said chest bib portion is detached and folded over and attached to said fixably attached portion of said chest bib portion by conventional male and female snap means, whereby said pair of chest side panel portions are exposed.

3. A device as claimed in claim 1, wherein said pair of chest side panel portions are comprised of a mesh material, whereby said player is ventilated so as not to become overheated during play.

4. A device as claimed in claim 1, wherein said pair of armpit portions are comprised of a mesh material, whereby said player is ventilated so as not to become overheated during play.

5. A device as claimed in claim 1, wherein an opening from said collar portion through said crotch portion, along a symmetrical vertical plane drawn through said upper and lower torso portions, is detachably attached by conventional zipper means, whereby said garment fits snugly during play to minimize accidents.

6. A device as claimed in claim 1, wherein a conventional belt device is detachably attached to said waist portion of said garment by conventional male and female buckle means, whereby said garment fits snugly during play to minimize accidents.

7. A device as claimed in claim 1, wherein a aesthetic quilted design is fixably attached by conventional stitch means to said garment's material's outer surface, whereby garment's material's strength is increased in order to withstand normal wear and tear during play.

8. A device as claimed in claim 1, wherein a conventional pocket with loop device is fixably attached by conventional stitch means to said garment's rear hip portion, whereby a squeegee for cleaning a paintball airgun can be easily accessible and stored during play.

9. A device as claim 1, wherein a plurality of loop devices, preferably comprised of elastic, are fixably attached by conventional stitch means to said garment's upper and lower torso portions, with said loop device's diameter measuring that of a paintball marker canister, whereby a plurality of said paintball marker canisters can be easily accessible and stored during play.

10. A device as claimed in claim 1, wherein a plurality of conventional pocket devices are fixably attached by conventional stitch means to said garment's upper and lower torso portions, whereby objects can be easily accessible and stored during play.

11. A device as claimed in claim 1, wherein said garment is comprised of a water resistant material, whereby said player will not get wet during play.

12. A device as claimed in claim 1, wherein said garment is dark colored with a camouflage pattern, whereby said player can blend into the surrounding environment.

* * * * *